US007289093B2

(12) United States Patent
Uchiyama

(10) Patent No.: US 7,289,093 B2
(45) Date of Patent: Oct. 30, 2007

(54) LIQUID CRYSTAL DISPLAY

(75) Inventor: Yuji Uchiyama, Chigasaki (JP)

(73) Assignee: Victor Company of Japan, Limited, Yokohama, Kanagawa-ken (JP)

( * ) Notice: Subject to any disclaimer, the term of this patent is extended or adjusted under 35 U.S.C. 154(b) by 601 days.

(21) Appl. No.: 10/975,004

(22) Filed: Oct. 28, 2004

(65) Prior Publication Data

US 2005/0093807 A1 May 5, 2005

(30) Foreign Application Priority Data

Oct. 29, 2003 (JP) ..... P2003-369499

(51) Int. Cl.
*G09G 3/36* (2006.01)

(52) U.S. Cl. ..... 345/89; 345/90

(58) Field of Classification Search ..... 345/88–100, 345/204; 348/235; 358/448, 450, 453, 461, 358/521

See application file for complete search history.

(56) References Cited

U.S. PATENT DOCUMENTS

| | | | | |
|---|---|---|---|---|
| 7,145,541 | B2 * | 12/2006 | Kurokawa et al. | 345/98 |
| 2003/0222840 | A1 * | 12/2003 | Koga et al. | 345/89 |
| 2004/0183975 | A1 * | 9/2004 | Yamaguchi et al. | 349/137 |
| 2005/0001846 | A1 * | 1/2005 | Shiono | 345/531 |
| 2005/0094899 | A1 * | 5/2005 | Kim et al. | 382/300 |
| 2007/0035503 | A1 * | 2/2007 | Kurokawa et al. | 345/98 |

FOREIGN PATENT DOCUMENTS

| | | |
|---|---|---|
| JP | 07-325308 | 12/1995 |
| JP | 2000-206544 | 7/2000 |

* cited by examiner

*Primary Examiner*—Nitin I. Patel
(74) *Attorney, Agent, or Firm*—The Nath Law Group; Jerald L. Meyer; Stanley N. Protigal

(57) ABSTRACT

In a liquid crystal display (LCD), a division point memory stores positional information about pixel division points that regularly divide X pixels and Y pixels on a display screen into sections. A gradation correction value memory stores gradation correction values that are prepared for the pixel division points and gradation division points, respectively, the gradation division points regularly dividing a maximum gradation level characteristic to the LCD into sections. A gradation level determination unit generates gradation level interpolation signals for pixel division points related to an input image signal according to the gradation correction values stored in the gradation correction value memory. A horizontal interpolation unit finds x-axis distances between a pixel position of the input image signal and positions of the pixel division points, and according to the found x-axis distances and the gradation level interpolation signals, generates horizontal interpolation signals. A vertical interpolation unit finds y-axis distances between the pixel position of the input image signal and the positions of the pixel division points, and according to the found y-axis distances and the horizontal interpolation signals, generates an image signal to be displayed on the LCD.

4 Claims, 9 Drawing Sheets

LIQUID CRYSTAL DISPLAY

BACKGROUND OF THE INVENTION

1. Field of the Invention

The present invention relates to a liquid crystal display servable as a projection display, a view finder, a head mount display, and the like. In particular, the present invention relates to a liquid crystal display capable of providing high-quality images by conducting interpolation to correct a nonlinear, uneven light intensity distribution caused by uneven liquid crystal alignment, irregular film thickness, and the like.

2. Description of Related Art

Generally, a liquid crystal display (hereinafter referred to as LCD) has a problem of causing an uneven light intensity distribution over a display screen due to an uneven alignment of liquid crystals or irregular film thickness.

To correct the problem, an LCD according to a related art shown in FIG. 1 employs a gamma correction unit 301, a weight shading correction unit 302, and a modulation shading correction unit 303.

Corrections made by these correction units of the related art will be explained in connection with an LCD display screen 20 shown in FIGS. 8 and 9.

FIG. 8 shows the display screen 20 of an LCD 100. A horizontal side of the display screen 20 is regularly divided into "M−1" sections, and a vertical side thereof into "N−1" sections. In the example of FIG. 8, each side of the display screen 20 is divided into ten sections. Each point that defines a divided section is referred to as a pixel division point P(m, n).

In the example of FIG. 8 where the display screen 20 is divided into ten sections in each of the horizontal and vertical directions, there are 121 pixel division points from P(1, 1) to P(11, 11). In this case, "m" in P(m, n) is defined as $1 \leqq m \leqq (M-1)$, and "n" as $1 \leqq n \leqq (N-1)$.

FIG. 9 is an enlarged view showing a part 20*a* of FIG. 8. In FIG. 9, a pixel on the display screen 20 is represented as G(x, y) by employing x- and y-coordinates on the display screen 20. A pixel G(x, y) is surrounded by four pixel division points P(m, n), P(m+1, n), P(m, n+1), and P(m+1, n+1). These four pixel division points surround a plurality of pixels including G(x, y), G(x−1, y), G(x+1, y+1), and the like. When the display screen 20 contains X pixels in the horizontal direction and Y pixels in the vertical direction, the variables x and y in G(x, y) are defined as $1 \leqq x \leqq X$, and $1 \leqq y \leqq Y$.

<Gamma Correction>

In the related art of FIG. 1, a first correction to be made is a gamma correction. An image signal S(x, y) for a pixel (x, y) on the display screen is supplied to the gamma correction unit 301. Generally, an LCD has a problem of causing an error if a light modulation ratio (V-T characteristic) is nonlinear relative to a voltage applied to liquid crystals in accordance with an image signal. Although not shown in FIG. 1, the gamma correction unit 301 stores gradation correction values to conduct a gradation correction against such a light modulation ratio error due to V-T characteristics. By using the gradation correction values, the gamma correction unit 301 corrects an error related to a nonlinear light modulation ratio and provides an output signal SG(x, y) to the weight shading correction unit 302.

<Weight Shading Correction>

The weight shading correction unit 302 carries out a weight shading correction to correct differences in the threshold voltages of liquid crystals contained in display pixels caused by uneven alignment of liquid crystals in a liquid crystal alignment film, irregular film thickness, and the like.

The weight shading correction unit 302 has a memory (not shown) to beforehand store threshold voltage difference correction values for the pixel division points, respectively. Namely, the unit 302 stores threshold voltage difference correction values STC_P(m, n), STC_P(m+1, n), STC_P(m, n+1), and STC_P(m+1, n+1) for the pixel division points P(m, n), P(m+1, n), P(m, n+1), and P(m+1, n+1), respectively. With the use of these correction values, the unit 302 carries out the weight shading correction by executing the below-mentioned expressions (1) and (2) in parallel and then the below-mentioned expressions (3) and (4) sequentially and provides an output signal SS(x, y). The signal SS(x, y) is supplied to the modulation shading correction unit 303.

$$STC1(x, y) = \mathrm{STC_P}(m, n) + \{\mathrm{STC_P}(m+1, n) - \mathrm{STC_P}(m, n)\} * (x-m)/\{x/(m-1)\} \quad (1)$$

$$STC1(x, y+1) = \mathrm{STC_P}(m, n+1) + \{\mathrm{STC_P}(m+1, n+1) - \mathrm{STC_P}(m, n+1)\} * (x-m)/\{x/(m-1)\} \quad (2)$$

$$STC2(x, y) = STC1(x, y) + \{STC1(x, y+1) - STC1(x, y)\} * (y-n)/\{y/(n-1)\} \quad (3)$$

$$SS(x, y) = STC2(x, y) + SG(x, y) \quad (4)$$

<Modulation Shading Correction>

The modulation shading correction unit 303 carries out a modulation shading correction to correct differences in light modulation among the liquid crystals of the display pixels caused by uneven alignment of liquid crystals in the liquid crystal alignment film, irregular film thickness, and the like.

The modulation shading correction unit 303 has a memory (not shown) to store light modulation difference correction values for the pixel division points, respectively. Namely, light modulation difference correction values DYN_P(m, n), DYN_P(m+1, n), DYN_P(m, n+1), and DYN_P(m+1, n+1) are stored for the pixel division points P(m, n), P(m+1, n), P(m, n+1), and P(m+1, n+1), respectively.

With the use of the stored correction values, the modulation shading correction unit 303 executes the below-mentioned expressions (5) and (6) in parallel and then the expression (7). Thereafter, the unit 303 employs the signal SS(x, y) provided by the weight shading correction unit 302 to carry out the modulation shading correction by executing the below-mentioned expression (8) and provides an output signal SD(x, y).

$$DYN1(x, y) = \mathrm{DYN_P}(m, n) + \{\mathrm{DYN_P}(m+1, n) - \mathrm{DYN_P}(m, n)\} * (x-m)/\{x/(m-1)\} \quad (5)$$

$$DYN1(x, y+1) = \mathrm{DYN_P}(m, n+1) + \{\mathrm{DYN_P}(m+1, n+1) - \mathrm{DYN_P}(m, n+1)\} * (x-m)/\{x/(m-1)\} \quad (6)$$

$$DYN2(x, y) = DYN1(x, y) + \{DYN1(x, y+1) - DYN1(x, y)\} * (y-n)/\{y/(n-1)\} \quad (7)$$

$$SD(x, y) = DYN2(x, y) * SS(x, y) \quad (8)$$

The output signal SD(x, y) from the modulation shading correction unit 303 is converted into a display image signal A(x, y), which is subjected to a level conversion to provide a liquid crystal drive signal level. As a result, a display image signal V(x, y) is supplied to the corresponding pixel to display an image.

The processes mentioned above usually employ LUTs (lookup tables) that receive memory addresses and provide corresponding data.

In this way, the LCD of the related art of FIG. 1 employs the gamma correction unit 301 to correct a V-T characteristic error according to the gradation correction values stored in advance.

The gradation correction values according to the related art are prepared without considering pixel positions and are used to correct errors caused by uneven liquid crystal alignment in an original alignment film and interference fringes caused by light made incident to liquid crystals and uneven film thickness. Namely, the related art is insufficient to correct errors caused by uneven liquid crystal alignment and irregular film thickness.

Japanese Unexamined Patent Application Publication No. Hei-7-325308 discloses a technique of controlling spacer detachment to improve image quality, and Japanese Unexamined Patent Application Publication No. 2000-206544 discloses a technique of improving image quality by controlling contamination of liquid crystals due to contaminants contained in a sealing agent. These techniques, however, do not suggest a technique of correcting image signals according to a display screen.

SUMMARY OF THE INVENTION

An object of the present invention is to provide an LCD capable of correcting unevenness more properly than the related arts and providing high-quality images.

In order to accomplish the object, a first aspect of the present invention provides an LCD having a first substrate provided with display pixels arrayed in a matrix of X pixels along a first side of the first substrate and Y pixels along a second side of the first substrate, a second substrate arranged in parallel with the first substrate, and liquid crystals sealed between the first and second substrates, a voltage being applied between the first and second substrates to display an image. The LCD includes: a division point memory that stores positional information about pixel division points that regularly divide the X pixels into "M−1" ($1 \leqq M \leqq X$) sections and the Y pixels into "N−1" ($1 \leqq N \leqq Y$) sections; a gradation correction value memory that stores, for each of the pixel division points, gradation correction values that are prepared in advance according to special test signals for gradation division points, respectively, which regularly divide a maximum gradation level characteristic to the LCD into sections; a gradation level determination unit configured to generate gradation level interpolation signals for pixel division points related to an input image signal according to the gradation correction values stored in the gradation correction value memory; a horizontal interpolation unit configured to find x-axis distances between a pixel position of the input image signal and positions of the pixel division points, and according to the found x-axis distances and the gradation level interpolation signals, generate horizontal interpolation signals; and a vertical interpolation unit configured to find y-axis distances between the pixel position of the input image signal and the positions of the pixel division points, and according to the found y-axis distances and the horizontal interpolation signals, generate an image signal to be displayed on the LCD.

According to the first aspect, gradation correction values are determined in consideration of the alignment unevenness, film thickness irregularity, and pixel positions of a given LCD and are stored. With the correction values, the first aspect can correct a nonlinear light intensity distribution caused by the alignment unevenness and film thickness irregularity of the LCD that is unsolvable by the related arts.

The first aspect divides the screen of the LCD as well as a maximum gradation level intrinsic to the LCD, provides gradation division points, and prepares correction values for the pixel division points and gradation division points. This configuration is simple and can provide high-quality images.

A second aspect of the present invention provides an LCD having a first substrate provided with display pixels arrayed in a matrix of X pixels along a first side of the first substrate and Y pixels along a second side of the first substrate, a second substrate arranged in parallel with the first substrate, and liquid crystals sealed between the first and second substrates, a voltage being applied between the first and second substrates to display an image. The LCD includes: a division point memory that stores positional information about pixel division points that regularly divide the X pixels into "M−1" ($1 \leqq M \leqq X$) sections and the Y pixels into "N−1" ($1 \leqq N \leqq Y$) sections; a gradation correction value memory that stores, for each of the pixel division points, gradation correction values that are prepared in advance according to special test signals for gradation division points, respectively, which irregularly divide a maximum gradation level characteristic to the LCD into sections; a gradation level determination unit configured to generate gradation level interpolation signals for pixel division points related to an input image signal according to the gradation correction values stored in the gradation correction value memory; a horizontal interpolation unit configured to find x-axis distances between a pixel position of the input image signal and positions of the pixel division points, and according to the found x-axis distances and the gradation level interpolation signals, generate horizontal interpolation signals; and a vertical interpolation unit configured to find y-axis distances between the pixel position of the input image signal and the positions of the pixel division points, and according to the found y-axis distances and the horizontal interpolation signals, generate an image signal to be displayed on the LCD.

According to the second aspect, gradation correction values are determined in consideration of the alignment unevenness, film thickness irregularity, and pixel positions of a given LCD and are stored. With the correction values, the second aspect can correct a nonlinear light intensity distribution caused by the alignment unevenness and film thickness irregularity of the LCD that is unsolvable by the related arts. In addition, the second aspect employs irregular gradation division points set according to the light intensity characteristics of the LCD, to correct an uneven light intensity distribution of the LCD.

According to a third aspect of the present invention, the gradation level determination unit conducts linear interpolation with the use of adjacent two of the gradation division points.

The nature, principle and utility of the invention will become more apparent from the following detailed description when read in conjunction with the accompanying drawings.

DETAILED DESCRIPTION OF EMBODIMENTS

Figure 1:
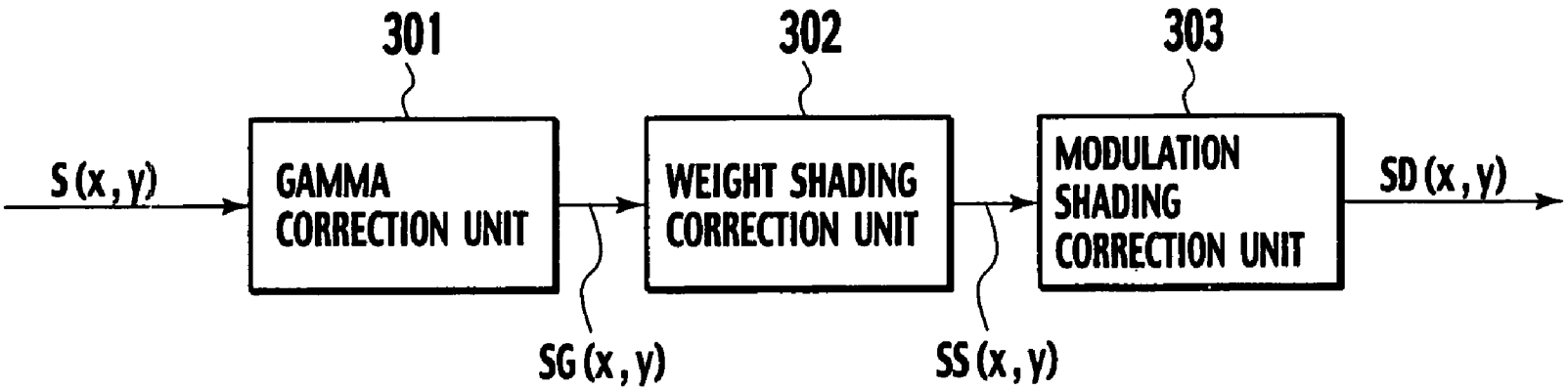
FIG. 1 PRIOR ART
FIG. 1 is a block diagram showing correction units of an LCD according to a related art.
Figure 2:
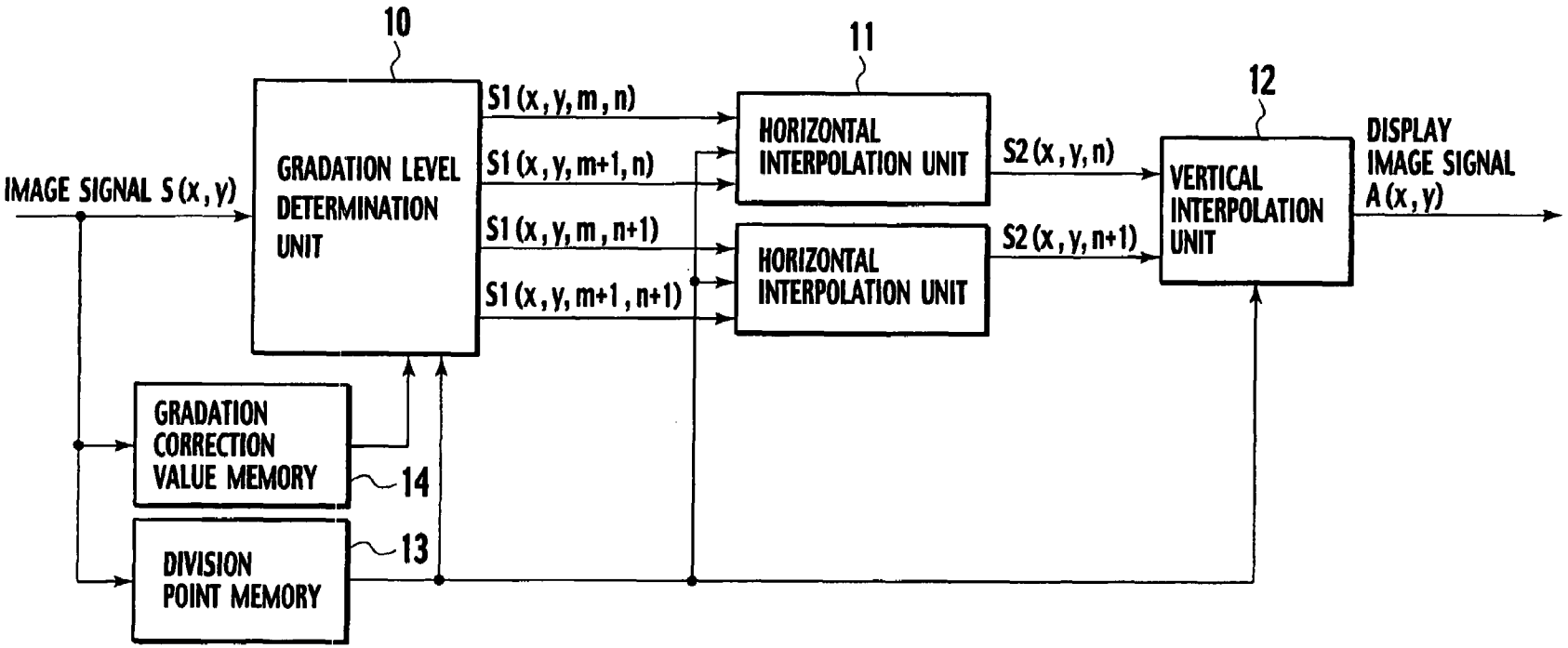
FIG. 2 is a block diagram showing correction units of an LCD according to an embodiment of the present invention.

FIG. 2 is a block diagram showing correction units of an LCD according to an embodiment of the present invention. Before explaining corrections conducted by the correction units of FIG. 2, the structure of a typical LCD 100 shown in FIG. 3 will be explained.

Figure 3:
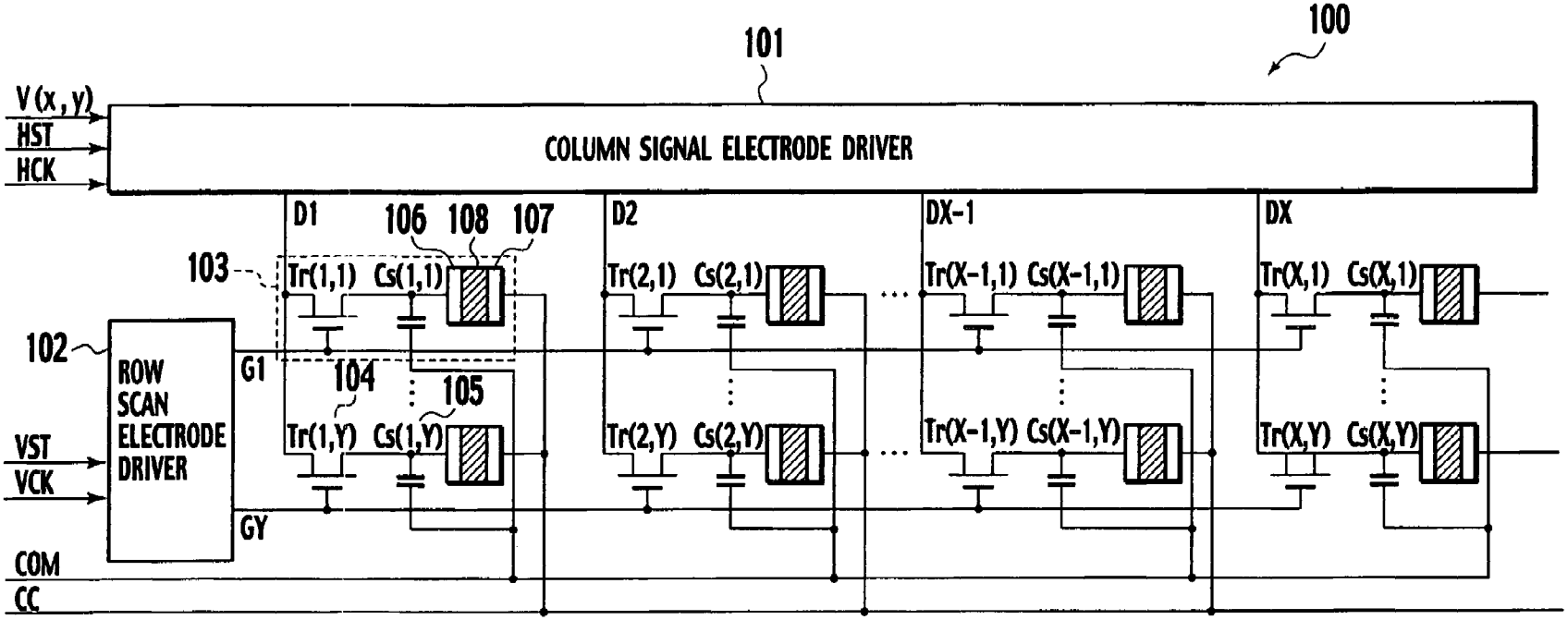
FIG. 3 shows a typical LCD.

The LCD 100 shown in FIG. 3 has a matrix of X pixels 103 in a horizontal direction and Y pixels 103 in a vertical direction. The pixels 103 are connected to a column signal electrode driver 101 and row scan electrode driver 102. Each of the pixels 103 includes a transistor 104, an auxiliary capacitor 105, a pixel electrode 106, a liquid crystal 108, and a common electrode 107. In this example, the transistor 104 in the first column and first row is represented as Tr(1, 1) and an auxiliary capacitor 105 at the same location as Cs(1, 1).

Figure 4:
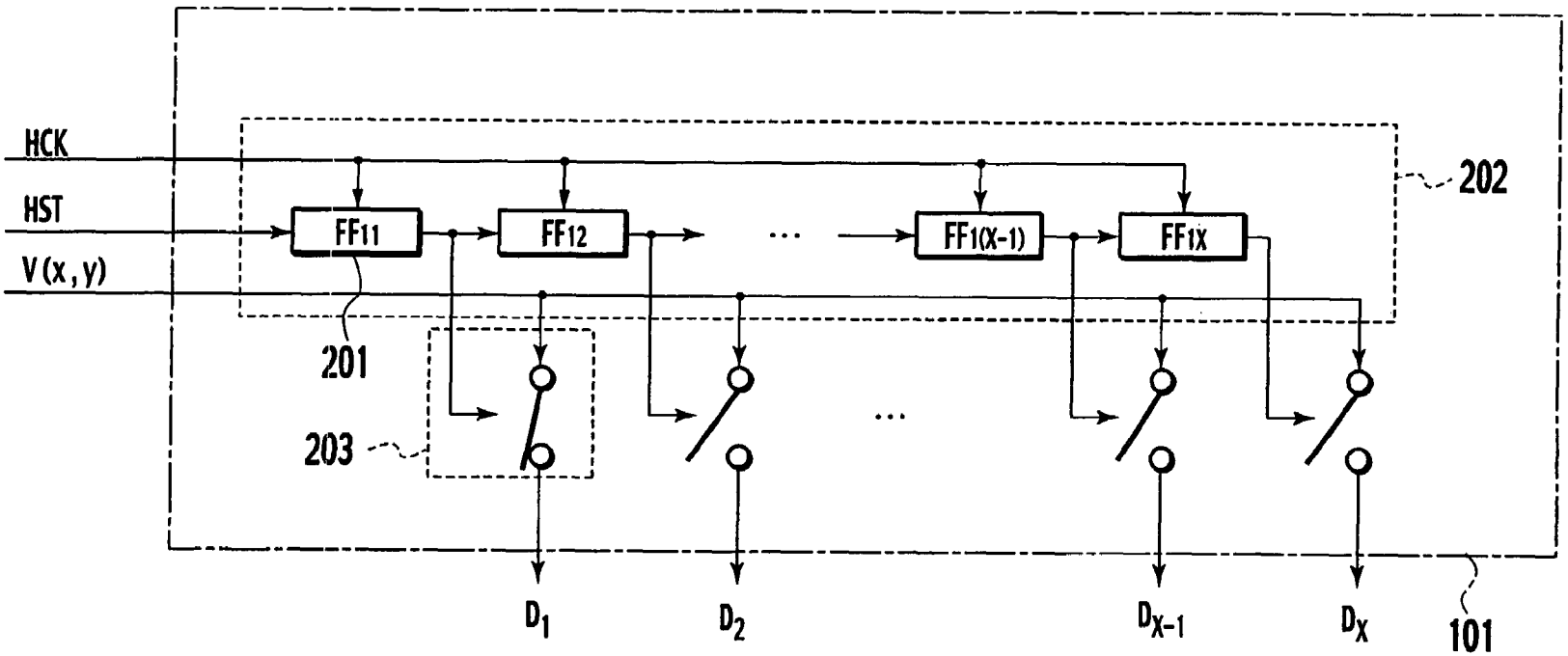
FIG. 4 shows a column signal electrode driver of the LCD of FIG. 3.

FIG. 4 shows the column signal electrode driver 101. The driver 101 includes a shift register 202 made of a plurality of flip-flops 201, and a plurality of analog switches 203.

When displaying an image, the column signal electrode driver 101 receives a column synchronizing signal (hereinafter referred to as horizontal synchronizing signal) HST, a clock signal HCK, and a display image signal V(x, y).

The received horizontal synchronizing signal HST and clock signal HCK are transferred to the shift register 202. The flip-flop $F_{11}$ latches the horizontal synchronizing signal HST in synchronization with the clock signal HCK. The flip-flop $FF_{12}$ latches an output of the flip-flop $FF_{11}$ in synchronization with the clock signal HCK.

Outputs of the flip-flops 201 control the switching of the analog switches 203, respectively. Each analog switch 203 is connected to a data line D and provides the data line D with the display image signal V(x, y). For example, the output of the flip-flop $FF_{11}$ controls the analog switch 203 to provide the data line $D_1$ with the display image signal. Similarly, the output of the flip-flop $FF_{12}$ provides the data line $D_2$ with the display image signal through the corresponding switch. The data lines $D_1$ to $D_x$ are connected to the sources of the transistors 104 of the pixels 103, respectively.

Figure 5:
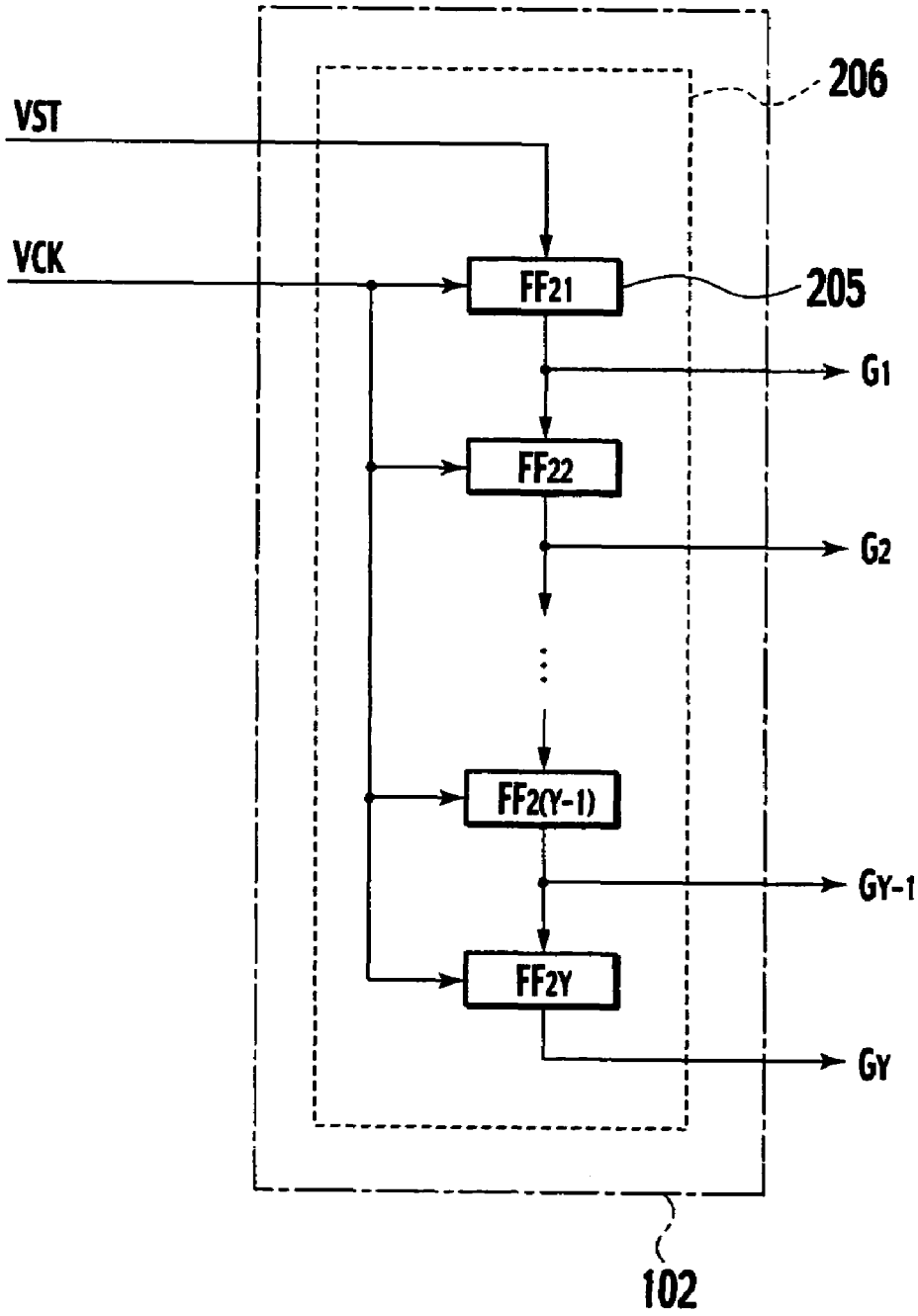
FIG. 5 shows a row scan electrode driver of the LCD of FIG. 3.

FIG. 5 shows the row scan electrode driver 102, which includes a shift register 206 made of a plurality of flip-flops 205.

The row scan electrode driver 102 receives a row synchronizing signal (hereinafter referred to as vertical synchronizing signal) VST synchronized with the display image signal, and a line clock signal VCK. The received vertical synchronizing signal VST and line clock signal VCK are transferred to the shift register 206. The flip-flop $FF_{21}$ latches the vertical synchronizing signal VST in synchronization with the line clock signal VCK. The flip-flop $FF_{22}$ latches an output of the flip-flop $FF_{21}$ in synchronization with the line clock signal VCK.

Outputs of the flip-flops 205 are connected to gate lines G connected to the gates of the transistors 104, respectively. For example, the output of the flip-flop $F_{21}$ is supplied to the gate line $G_1$ and the output of the flop-flop $FF_{22}$ to the gate line $G_2$. The gate lines $G_1$ to $G_Y$ are connected to the gates of the transistors 104 of the pixels 103, respectively.

In this arrangement, the transistor 104 in each pixel is turned on in response to the display image signal V(x, y). The auxiliary capacitor 105 stores a potential difference between the display image signal and a common electrode COM and applies a potential difference between the display image signal and a common electrode CC to the pixel electrode 106 and liquid crystal 108. According to an electric field strength caused by the potential difference, the liquid crystal 108 causes electric field double refraction to display an image on the display screen 20 through a polarization optical system.

<<First Embodiment>>

A first embodiment of the present invention will be explained with reference to the accompanying drawings.

As shown in the block diagram of FIG. 2, an LCD 100 according to the first embodiment of the present invention carries out a series of interpolations and includes a gradation level determination unit 10, a horizontal interpolation unit 11, a vertical interpolation unit 12, a division point memory 13, and a gradation correction value memory 14.

The gradation level determination unit 10, horizontal interpolation unit 11, and vertical interpolation unit 12 carry out gradation level determination, horizontal interpolation, and vertical interpolation on an input image signal.

The division point memory 13 stores information about pixel division points that regularly divide X pixels along a horizontal side of a display screen 20 of the LCD 100 into "M−1" ($1 \leqq M \leqq X$) sections and Y pixels along a vertical side of the display screen 20 into "N−1" ($1 \leqq N \leqq Y$) sections.

The pixel division point information is positional information (coordinate information) about each of the pixel division points. When conducting an interpolation, the horizontal interpolation unit 11 or vertical interpolation unit 12 calculates a distance between each pixel division point and a given pixel based on the pixel division point positional information and the coordinate information of the pixel and uses the calculated distance.

The division numbers "M−1" and "N−1" are determined in advance according to required correction accuracy. The gradation correction value memory 14 stores gradation correction values L for the pixel division points. The gradation correction values L are measured and set in advance for a given LCD. To measure the gradation correction values, special test signals are input to the LCD, and according to the test signals, the correction values are determined. A gradation correction value L is set for each gradation division point of each pixel division point. The gradation division points are points that regularly divide a maximum gradation level $D_{max}$ of an image signal into "T−1" sections where T is an integer satisfying $1 \leqq T \leqq D_{max}$.

Figure 8:
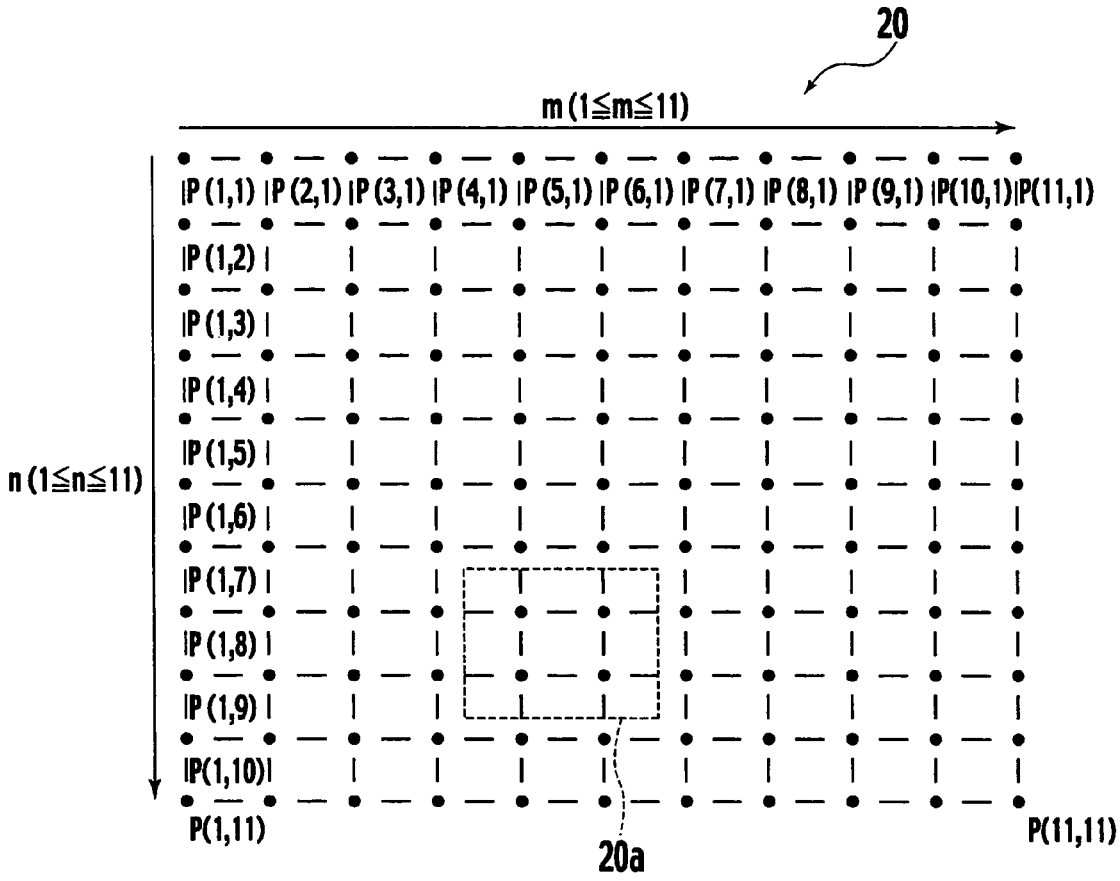
FIG. 8 shows a display screen of a typical LCD.

FIG. 8 used to explain the related art shows the display screen 20 according to the present invention. In FIG. 8, the display screen 20 is divided into ten sections in each of horizontal and vertical directions. According to this embodiment, the number of pixels in the horizontal direction is 800 and M =9. Accordingly, the number of pixels between adjacent pixel division points in the horizontal direction is 100 (=800/(9−1)). Each pixel division point is provided with gradation correction values, and each gradation correction value covers 100 pixels in the horizontal direction. If M=101, then the number of pixels between adjacent pixel division points in the horizontal direction is 8 (=800/ (101−1)). In this case, each gradation correction value covers eight pixels in the horizontal direction. The setting of M=101 realizes more precise correction than the setting of M=9. Since each pixel division point is provided with gradation correction values, the setting of M=101 increases the number of gradation correction values that must be stored in advance, to complicate the system. Accordingly, the division numbers "M−1" and "N−1" must be determined according to required correction accuracy and system cost.

Figure 9:
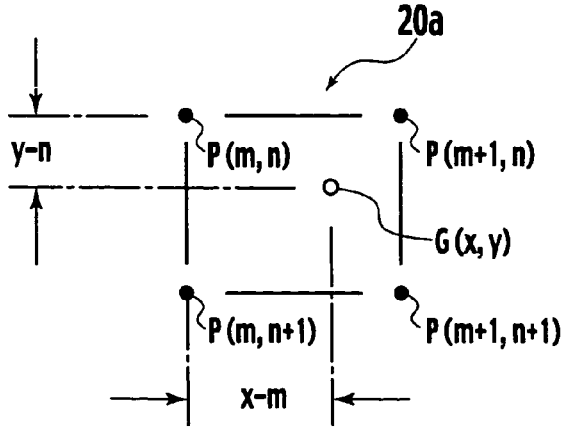
FIG. 9 shows the details of a part of the display screen of FIG. 8.

A pixel on the display screen 20 is expressed as G(x, y), where x is a horizontal pixel number satisfying $1 \leqq x \leqq X$ and y is a vertical pixel number satisfying $1 \leqq y \leqq Y$. In FIG. 9 that is an enlarged view showing a part 20*a* of the display screen 20, the pixel G(x, y) is surrounded by four pixel division points P(m, n), P(m+1, n), P(m, n+1), and P(m+1, n+1).

The division point memory 13 stores for the pixel G(x, y), for example, information related to positions of the four pixel division points P(m, n), P(m+1, n), P(m, n+1), and P(m+1, n+1).

Figure 6:
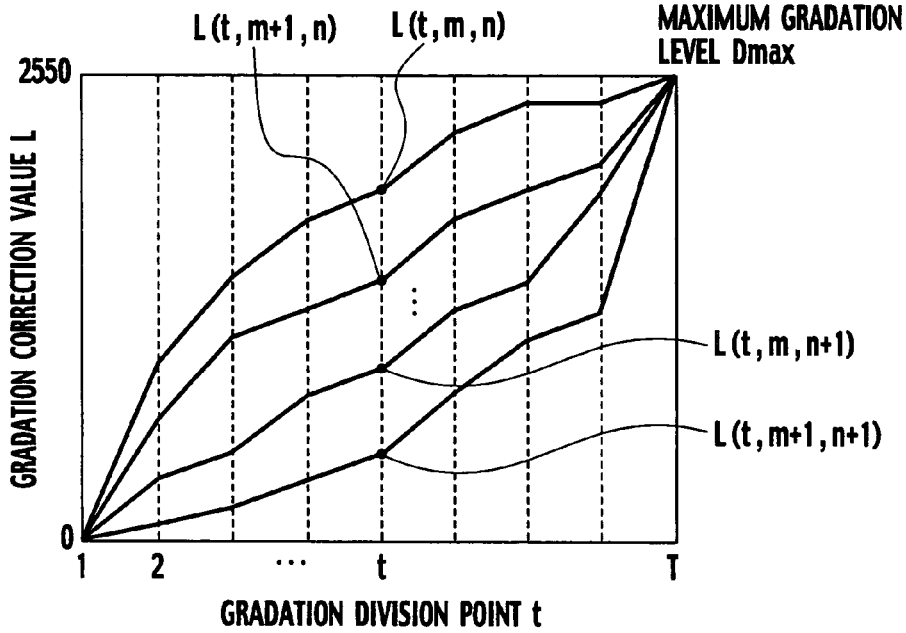
FIG. 6 is a graph showing relationships between gradation correction values and gradation division points on an LCD according to a first embodiment of the present invention.

The gradation correction values L will be explained with reference to the graph of FIG. 6 showing the gradation correction values L and gradation division points t. A gradation correction value for the pixel division point P(m, n) at a gradation division point "t" is expressed as L(t, m, n). A division number "T−1" and a gradation division point t have a relationship of $1 \leqq t \leqq (T-1)$.

<Gradation Level Determination>

Receiving an image signal S(x, y), the gradation level determination unit 10 inputs division point information with respect to the image signal S(x, y) from the division point memory 13: four pixel division points P(m, n), P(m+1, n), P(m, n+1), and P(m+1, n+1) satisfying relations of $m \leqq x < m+1$, and $n \leqq y < n+1$. Then, the gradation level determination unit 10 inputs gradation correction values L corresponding to the four pixel division points P(m, n), P(m+1, n), P(m, n+1), and P(m+1, n+1) from the gradation correction value memory 14 based on the value of the image signal S(x, y). Namely, the gradation level determination unit 10 inputs gradation correction values L(t, m, n), L(t+1, m, n), L(t, m+1, n), L(t+1, m+1, n), L(t, m, n+1), L(t+1, m, n+1), L(t, m+1, n+1), and L(t+1, m+1, n+1) in which a relation of $D(t) \leqq S(x, y) < D(t+1)$ is satisfied.

To determine a gradation level of, for example, the apex or pixel division point P(m, n), the gradation level determination unit 10 calculates the below-mentioned expression (9) to provide a signal S1(x, y, m, n).

$$S1(x, y, m, n) = L(t, m, n) + \{L(t+1, m, n) - L(t, m, n)\} * \{L(t, m, n) - S(x, y)\} / \{D_{\max} / (T-1)\} \tag{9}$$

Similarly, the expression (10) for the apex P(m+1, n), the expression (11) for the apex P(m, n+1), and the expression (12) for the apex P(m+1, n+1) are calculated to complete the gradation level determination and provide output signals S1(x, $$S1(x, y, m+1, n) = L(t, m+1, n) + \{L(t+1, m+1, n) - L(t, m+1, n)\} * \{L(t, m+1, n) - S(x, y)\} / \{D_{\max} / (T-1)\} \tag{10}$$

$$S1(x, y, m, n+1) = L(t, m, n+1) + \{L(t+1, m, n+1) - L(t, m, n+1)\} * \{L(t, m, n+1) - S(x, y)\} / \{D_{\max} / (T-1)\} \tag{11}$$

$$S1(x, y, m+1, n+1) = L(t, m+1, n+1) + \{L(t+1, m+1, n+1) - L(t, m+1, n+1)\} * \{L(t, m+1, n+1) - S(x, y)\} / \{D_{\max} / (T-1)\} \tag{12}$$

Figure 7:
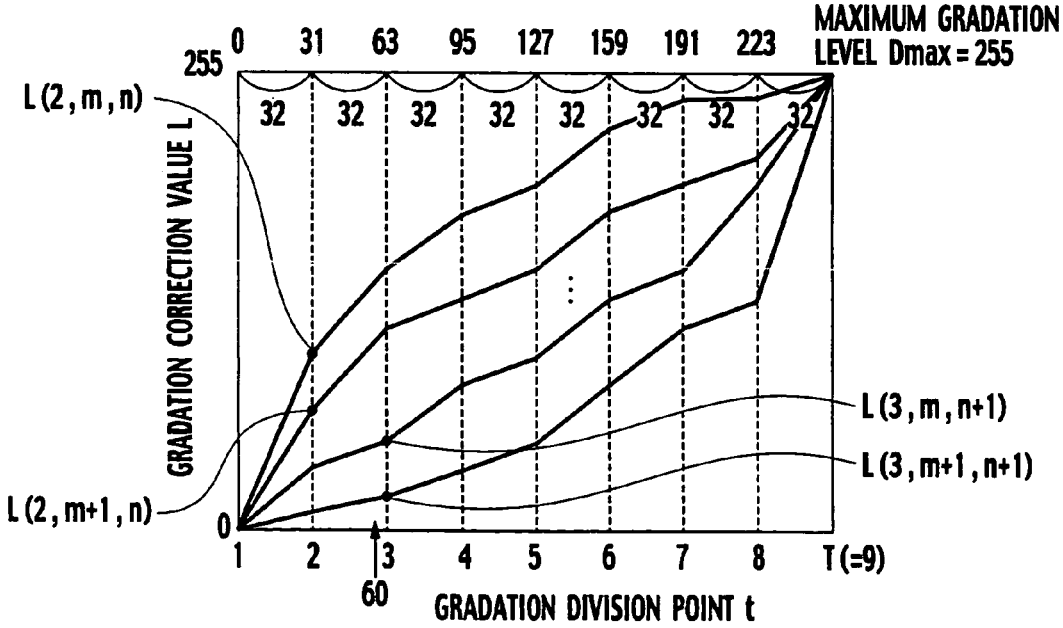
FIG. 7 is a graph showing relationships between gradation correction values and gradation division points according to the first embodiment.

A concrete example of the gradation level determination will be explained with reference to FIG. 7. The maximum gradation level $D_{max}$ is 255. The maximum gradation level $D_{max}$ is regularly divided into eight sections, i.e., T=9. In this case, each section involves 32 gradation levels. If the input signal S(x, y) has a gradation level of 60, gradation division points on each side of this gradation level are t=2 and t=3. Then, the gradation division point t=2 has gradation correction values L(2, n, m), L(2, n+1, m), L(2, n, m+1), L(2, n+1, m+1), and the gradation division point t=3 has gradation correction values L(3, n, m), L(3, n+1, m), L(3, n, m+1), L(3, n+1, m+1). With these gradation correction values L, the gradation level determination is conducted for four pixel division points P(m, n), P(m+1, n), P(m, n+1), P(m+1, n+1).

<Horizontal Interpolation>

Next, the horizontal interpolation unit 11 carries out a horizontal interpolation. The horizontal interpolation unit 11 receives the four signaly S1(x, y, m, n), S1(x, y, m+1, n), S1(x, y, m, n+1), S1(x, y, m+1, n+1) from the gradation level determination unit 10, as well as division point information with respect to the image signal S(x, y) from the division point memory 13: four pixel division points P(m, n), P(m+1, n), P(m, n+1), and P(m+1, n+1). Then, the horizontal interpolation unit 11 simultaneously calculates the following expressions (13) and (14) to provide signals S2(x, y, n) and S2(x, y, n+1).

$$S2(x, y, n) = S1(x, y, m, n) + \{S1(x, y, m+1, n) - S1(x, y, m, n)\} * (x-m) / (x/m) \tag{13}$$

$$S2(x, y, n+1) = S1(x, y, m, n+1) + \{S1(x, y, m+1, n+1) - S1(x, y, m, n+1)\} * (x-m) / (x/m) \tag{14}$$

<Vertical Interpolation>

Next, the vertical interpolation unit 12 carries out a vertical interpolation.

The vertical interpolation unit 12 receives the two signal S2(x, y, n), S2(x, y, n+1) from the horizontal interpolation unit 11, as well as division point information with respect to the image signal S(x, y) from the division point memory 13: four pixel division points P(m, n), P(m+1, n), P(m, n+1), and P(m+1, n+1). Then, the vertical interpolation unit 12 calculates the following expression (15) to carry out the vertical interpolation and provide a display image signal A(x, y).

$$A(x, y) = S2(x, y, n) + \{S2(x, y, n+1) - S2(x, y, n)\} * (y - n)/(y/n) \quad (15)$$

The display image signal A(x, y) provided by the vertical interpolation is subjected to a level conversion process (not shown) to provide a signal V(x, y) having a liquid crystal drive signal level, and the signal V(x, y) is supplied to a display element. The signal V(x, y) is input to the column signal electrode driver 101 to display a high-quality image based on the image signal.

The first embodiment mentioned above carries out corrections based on the positional information of each pixel and thus displays high-quality images on the LCD.

<<Second Embodiment>>

A second embodiment according to the present invention will be explained.

Like the first embodiment, the second embodiment employs the gradation level determination unit 10, horizontal interpolation unit 11, and vertical interpolation unit 12 shown in FIG. 2 to conduct a series of interpolations on an image signal S(x, y) according to data from the division point memory 13 and gradation correction value memory 14.

Like the first embodiment, the division point memory 13 stores division point information about pixel division points that regularly divide X pixels along a horizontal side of the display screen 20 into "M−1" (1≦M≦X) sections and Y pixels along a vertical side of the display screen 20 into "N−1" (1≦N≦Y) sections as shown in FIGS. 8 and 9. The gradation correction value memory 14 stores gradation correction values L shown in FIG. 10.

Figure 10:
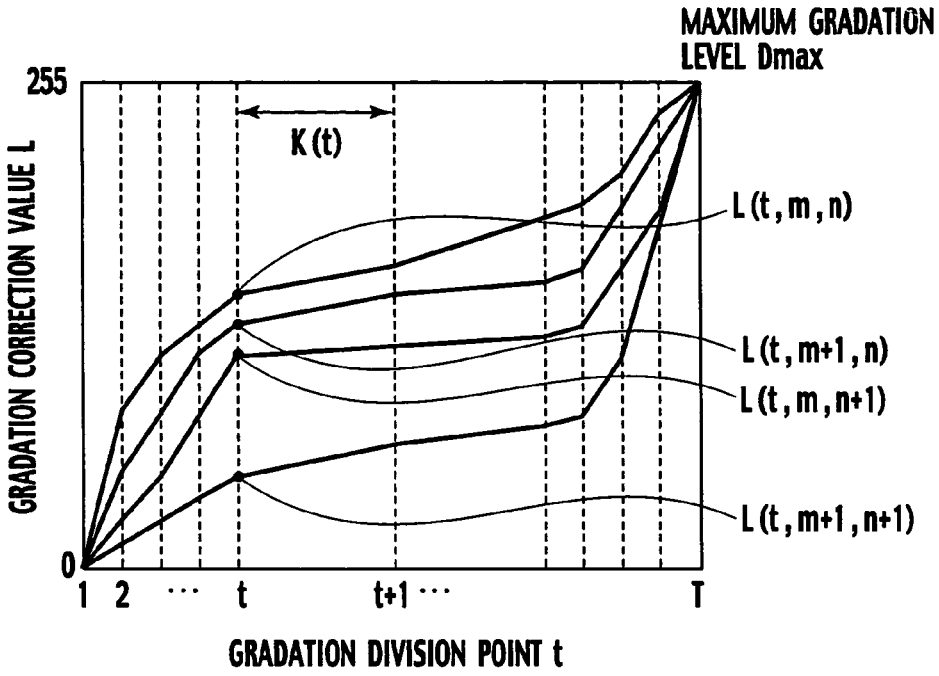
FIG. 10 is a graph showing relationships between gradation correction values and gradation division points on an LCD according to a second embodiment of the present invention.
Figure 12:
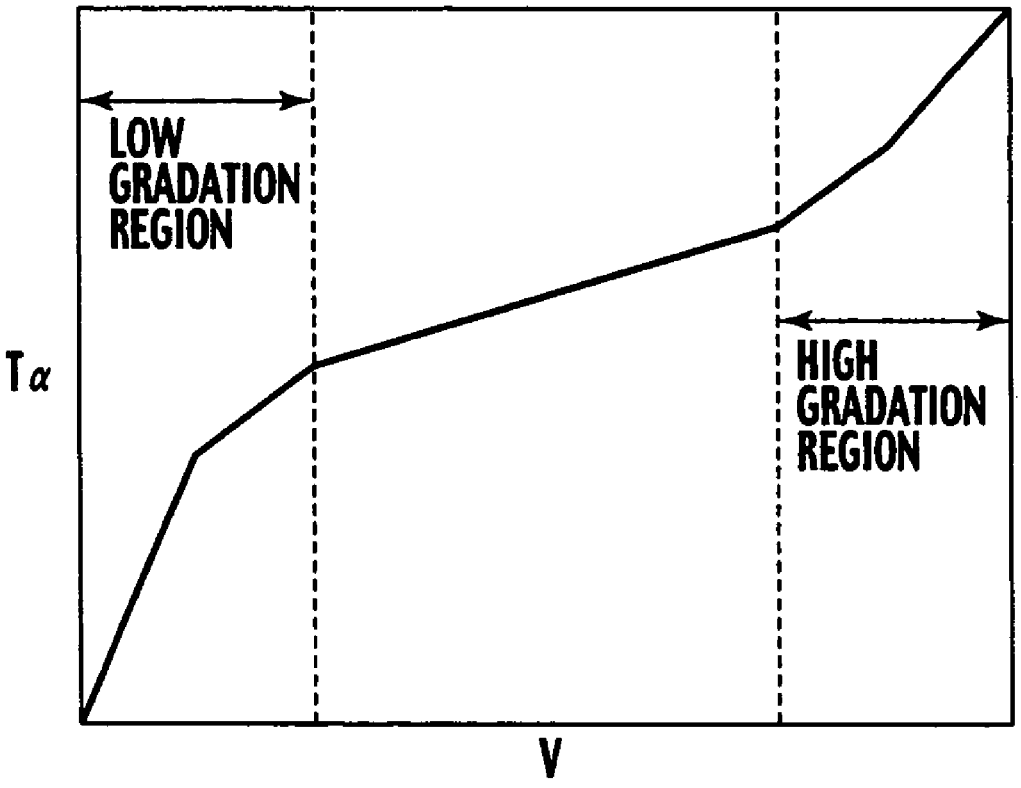
FIG. 12 shows a nonlinear V-T characteristic of liquid crystals.

The second embodiment differs from the first embodiment in that the gradation correction values L shown in FIG. 10 are selected to finely correct a low gradation region and high gradation region shown in FIG. 12 where light intensity Ta sharply changes to easily cause errors and roughly correct the other regions where the light intensity Ta gently changes. This configuration enables the LCD to provide higher quality images.

As shown in FIG. 10, a maximum gradation level $D_{max}$ of an image signal is irregularly divided into "T−1" sections, and a gradation correction value L is assigned to each divided gradation point for each pixel division point.

A gradation correction value for the pixel division point P(m, n) at a gradation division point "t" is expressed as L(t, m, n). A division number "T−1" and a gradation division point "t" have a relationship of 1≦t≦(T−1). A gradation difference between a gradation division point "t+1" and a gradation division point "t" is expressed as K(t).

A series of interpolations carried out according to the second embodiment will be explained with reference to FIG. 2.

<Gradation Level Determination>

Like the first embodiment, receiving an image signal S(x, y), the gradation level determination unit 10 inputs division point information with respect to the image signal S(x, y) from the division point memory 13: four pixel division points P(m, n), P(m+1, n), P(m ,n+1), and P(m+1, n+1) satisfying relations of m≦x<m+1, and n≦y<n+1. Then, the gradation level determination unit 10 inputs gradation correction values L corresponding to the four pixel division points P(m, n), P(m+1, n), P(m, n+1), and P(m+1, n+1) from the gradation correction value memory 14 based on the value of the image signal S(x, y). Namely, the gradation level determination unit 10 inputs gradation correction values L (t, m, n), L(t+1, m, n), L(t, m+1, n), L(t+1, m+1, n), L(t, m, n+1), L(t+1, m, n+1), L(t, m+1, n+1) and L(t+1m+1n+1) in which a relation of D(t)≦S(x, y)<D(t+1) is satisfied.

To determine a gradation level of, for example, the apex or pixel division point P(m, n), the gradation level determination unit 10 calculates the below-mentioned expression (16) to provide a signal S1(x, y, m, n).

$$S1(x, y, m, n) = L(t, m, n) + \{L(t+1, m, n) - L(t, m, n)\} * \{L(t, m, n) - S(x, y)\}/K(t) \quad (16)$$

Similarly, the expression (10) for the apex P(m+1, n), the expression (11) for the apex P(m, n+1), and the expression (12) for the apex P(m+1, n+1) are calculated to complete the gradation level determination and provide output signals S1(x, y, m+1, n), S1(x, y, m, n+1), S1(x, y, m+1, n+1).

$$S1(x, y, m+1, n) = L(t, m+1, n) + \{L(t+1, m+1, n) - L(t, m+1, n)\} * \{L(t, m+1, n) - S(x, y)\}/K(t) \quad (17)$$

$$S1(x, y, m, n+1) = L(t, m, n+1) + \{L(t+1, m, n+1) - L(t, m, n+1)\} * \{L(t, m, n+1) - S(x, y)\}/K(t) \quad (18)$$

$$S1(x, y, m+1, n+1) = L(t, m+1, n+1) + \{L(t+1, m+1, n+1) - L(t, m+1, n+1)\} * \{L(t, m+1, n+1) - S(x, y)\}/K(t) \quad (19)$$

The gradation correction values L according to the second embodiment will be explained in detail with reference to FIG. 11 where a maximum gradation level $D_{max}$ is 255 which is irregularly divided into ten sections.

Dividing the maximum gradation level $D_{max}$ into ten sections corresponds to T=11. When irregularly dividing the maximum gradation level, the intervals thereof are optionally determinable. In this example, a region where gradation changes sharply is finely divided and a region where gradation changes gently is roughly divided.

Figure 11:
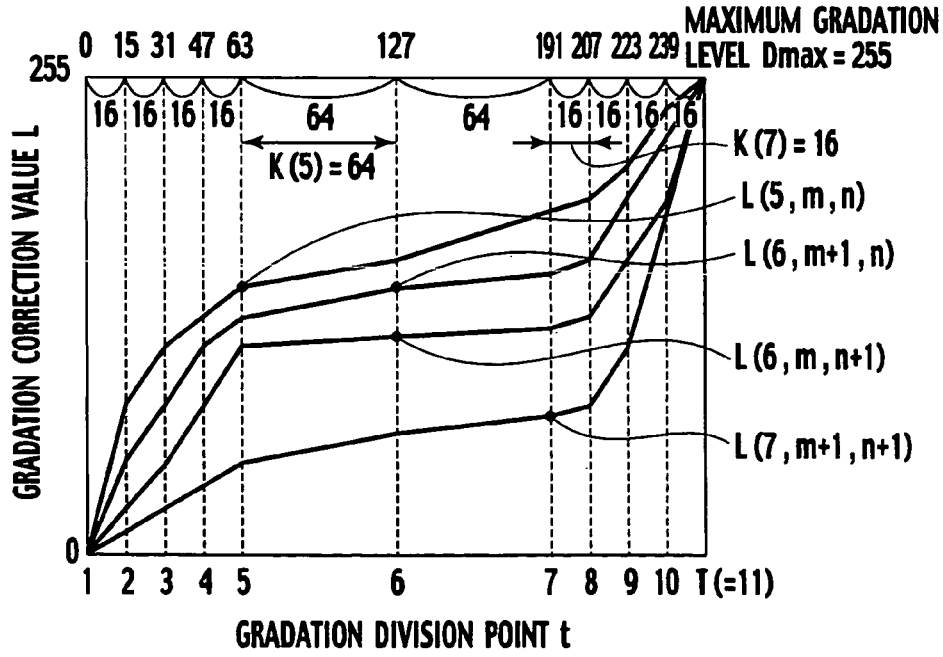
FIG. 11 is a graph showing relationships between gradation correction values and gradation division points according to the second embodiment.

In FIG. 11, regions of gradation levels of 0 to 63 and 192 to 255 where gradation sharply changes are divided at intervals of 16 gradation levels, and a region of gradation levels of 64 to 191 is divided at intervals of 64 gradation levels. Gradation division points "t+1" and "t" involve a gradation difference K(t). For example, a gradation difference K(5) between t=6 (gradation level of 127) and t=5 (gradation level of 64) is equal to 64, and a gradation difference K(9) between t=10 (gradation level of 239) and. t=9 (gradation level of 224) is equal to 16.

If an input image signal has a gradation level of 100, gradation correction values to be used for this input image signal are L(5, n, m), L(6, n, m), L(5, n+1, m), L(6, n+1, m), L(5, n, m+1), L(6, n, m+1), L(5, n+1, m+1), L(6, n+1, m+1) stored for adjacent gradation division points t=5 and t=6.

<Horizontal Interpolation>

Next, the horizontal interpolation unit 11 carries out a horizontal interpolation. The horizontal interpolation unit 11 receives the four signals S1(x, y, m, n), S1(x, y, m+1, n), S1(x, y, m, n+1), S1(x, y, m+1, n+1) from the gradation level determination unit 10, as well as S(x, y) from the division point memory 13: four pixel division points P(m, n), P(m+1, n), P(m, n+1), and P(m+1, n+1). Then, the horizontal interpolation unit 11 simultaneously calculates the following expressions (20) and (21) to provide signals S2(x, y, n) and S2(x, y, n+1).

$$S2(x, y, n) = S1(x, y, m, n) + \{S1(x, y, m+1, n) - S1(x, y, m, n)\} * (x-m)/(x/m) \quad (20)$$

$$S2(x, y, n+1) = S1(x, y, m, n+1) + \{S1(x, y, m+1, n+1) - S1(x, y, m, n+1)\} * (x-m)/(x/m) \quad (21)$$

<Vertical Interpolation>

The vertical interpolation unit 12 receives the two signals S2(x, y, n) and S2(x, y, n+1) from the horizontal interpolation unit 11, as well as division point information with respect to the image signal S(x, y) from the division point memory 13: four pixel division points P(m, n), P(m+1, n), P(m, n+1), and P(m+1, n+1). Then, the vertical interpolation unit 12 calculates the following expression (22) to carry out the vertical interpolation and provide a signal S3(x, y).

$$S3(x, y) = S2(x, y, n) + \{S2(x, y, n+1) - S2(x, y, n)\} * (y-n)/(y/n) \quad (22)$$

The vertically interpolated signal serves as a display image signal and is subjected to a level conversion process (not shown) to provide a signal having a liquid crystal driving level, which is supplied as a signal V(x, y) to a display element to display a high-quality image according to the image signal.

The second embodiment mentioned above conducts corrections according to the positional information of each pixel and variations in light intensity Ta, to further realize an even light intensity distribution.

It should be understood that many modifications and adaptations of the invention will become apparent to those skilled in the art and it is intended to encompass such obvious modifications and changes in the scope of the claims appended hereto.

What is claimed is:

1. A liquid crystal display having a first substrate provided with display pixels arrayed in a matrix of X pixels along a first side of the first substrate and Y pixels along a second side of the first substrate, a second substrate arranged in parallel with the first substrate, and liquid crystals sealed between the first and second substrates, a voltage being applied between the first and second substrates to display an image, the liquid crystal display comprising:

a division point memory that stores positional information about pixel division points that regularly divide the X pixels into "M−1" ($1 \leqq M \leqq X$) sections and the Y pixels into "N−1" ($1 \leqq N \leqq Y$) sections;

a gradation correction value memory that stores, for each of the pixel division points, gradation correction values that are prepared in advance according to special test signals for gradation division points, respectively, which regularly divide a maximum gradation level characteristic to the liquid crystal display into sections;

a gradation level determination unit configured to generate gradation level interpolation signals for pixel division points related to an input image signal according to the gradation correction values stored in the gradation correction value memory;

a horizontal interpolation unit configured to find x-axis distances between a pixel position of the input image signal and positions of the pixel division points, and according to the found x-axis distances and the gradation level interpolation signals, generate horizontal interpolation signals; and a vertical interpolation unit configured to find y-axis distances between the pixel position of the input image signal and the positions of the pixel division points, and according to the found y-axis distances and the horizontal interpolation signals, generate an image signal to be displayed on the liquid crystal display.

2. The liquid crystal display according to claim 1, wherein:

the gradation level determination unit conducts linear interpolation with the use of adjacent two of the gradation division points.

3. A liquid crystal display having a first substrate provided with display pixels arrayed in a matrix of X pixels along a first side of the first substrate and Y pixels along a second side of the first substrate, a second substrate arranged in parallel with the first substrate, and liquid crystals sealed between the first and second substrates, a voltage being applied between the first and second substrates to display an image, the liquid crystal display comprising:

a division point memory that stores positional information about pixel division points that regularly divide the X pixels into "M−1" ($1 \leqq M \leqq X$) sections and the Y pixels into "N−1" ($1 \leqq N \leqq Y$) sections;

a gradation correction value memory that stores, for each of the pixel division points, gradation correction values that are prepared in advance according to special test signals for gradation division points, respectively, which irregularly divide a maximum gradation level characteristic to the liquid crystal display into sections;

a gradation level determination unit configured to generate gradation level interpolation signals for pixel division points related to an input image signal according to the gradation correction values stored in the gradation correction value memory;

a horizontal interpolation unit configured to find x-axis distances between a pixel position of the input image signal and positions of the pixel division points, and according to the found x-axis distances and the gradation level interpolation signals, generate horizontal interpolation signals; and a vertical interpolation unit configured to find y-axis distances between the pixel position of the input image signal and the positions of the pixel division points, and according to the found y-axis distances and the horizontal interpolation signals, generate an image signal to be displayed on the liquid crystal display.

4. The liquid crystal display according to claim 3, wherein:

the gradation level determination unit conducts linear interpolation with the use of adjacent two of the gradation division points.

* * * * *